United States Patent [19]

Aubert

[11] Patent Number: 5,050,140

[45] Date of Patent: Sep. 17, 1991

[54] ALARM CLOCK

[75] Inventor: Christophe Aubert, Fontainemelon, Switzerland

[73] Assignee: Eta S.A. Fabriques d'Ebauches, Granges, Switzerland

[21] Appl. No.: 669,096

[22] Filed: Mar. 13, 1991

[30] Foreign Application Priority Data

Mar. 13, 1990 [CH] Switzerland ..... 00814/90

[51] Int. Cl.[5] ..... G04B 23/02

[52] U.S. Cl. ..... 368/262

[58] Field of Search ..... 368/72-74, 368/101-113, 250, 262-264

[56] References Cited

U.S. PATENT DOCUMENTS

| | | | |
|---|---|---|---|
| 3,352,101 | 11/1967 | Michael et al. | 368/262 |
| 3,371,478 | 3/1968 | Robinson | 368/262 |
| 3,382,664 | 5/1968 | Cielaszyk | 368/262 |
| 3,604,200 | 9/1971 | Sadder | 368/262 |
| 3,721,789 | 3/1973 | Black | 200/167 R |
| 3,797,223 | 3/1974 | Oliveri | 368/262 |
| 4,319,106 | 3/1982 | Armitage | 200/153 J |
| 4,352,170 | 9/1982 | Jetter | 368/73 |
| 4,505,597 | 3/1985 | Ilinn, Jr. | 368/250 |

FOREIGN PATENT DOCUMENTS

| | | |
|---|---|---|
| 511472 | 11/1966 | Switzerland . |
| 1202725 | 8/1970 | United Kingdom . |

*Primary Examiner*—Vit W. Miska

*Attorney, Agent, or Firm*—Griffin Branigan & Butler

[57] ABSTRACT

An alarm clock having a case, an alarm signal generator and means for setting and cancelling an alarm circuit, said case being adapted to rest upon a rigid surface by foot means, the latter being capable of movement between two positions and projecting from the base of the case, said foot means being furthermore connected to said setting and cancelling means in such a way that, on the one hand, these latter are actuated by application of pressure to the case and that, on the other hand, the case shifts from a first position to a second position in response to said pressure, the foot means furthermore having means for returning the case of the alarm clock to its first position following application of said pressure, said foot means comprising auxiliary means permitting successive applications of pressure to the case to set and cancel the alarm circuit, and by the foot means being connected to means displaying the set and cancelled status of the alarm circuit of the alarm clock.

8 Claims, 4 Drawing Sheets

ALARM CLOCK

BACKGROUND OF THE INVENTION

This invention relates to alarm clocks and more particularly table alarm clocks having setting and cancelling means for the alarm signal by pressure on the alarm clock case.

In the following description, setting is to be understood as placing the bell circuit in a state of readiness, the circuit under these conditions being prepared to be actuated in response to a given signal, and cancelling is to be understood as putting the alarm function out of service as well as interrupting the alarm signal.

DESCRIPTION OF THE PRIOR ART

In conventional table alarm clocks, the setting and cancelling button of the alarm signal, which hereafter will be termed the on-off button, is generally provided on the upper surface of the case, or in some instances on the back of the alarm clock case.

Although this type of alarm clock functions in a satisfactory manner, the arrangement of the on-off button often makes its operation laborious under normal conditions. This is especially the case when the user, who is usually still drowsy, has to locate and operate the on-off button in a dimly lit bedroom. Of course this operation is even more complicated when the on-off button is located on the back of the alarm clock case.

It is therefore easy to understand the inconvenience resulting from these difficult and consequently unpredictable operations.

Furthermore, the arrangement of an on-off button conspicuously on the surface of the case detracts from the pleasant appearance of an alarm clock, the present trend of manufacturers being to produce an alarm clock with cases having as few control buttons and switches visible from the outside as possible.

The alarm clock described in Swiss Patent No. 511 472 attempts to provide an initial solution to the problem set out above. This earlier alarm clock has a stop button for the alarm which, projecting from the base of the case, forms a foot and which, when the bell mechanism is set, raises this case appreciably. To turn off the alarm, it suffices to press on the alarm clock. A stem connected to the foot then actuates a mechanism stopping the vibration of a strip actuated by a suitable device. To reset the alarm clock, it is then necessary to take hold of it and grasp the button forming the foot and draw it outwards in order to disengage the bell mechanism.

The result is that with such a device, for resetting the alarm clock the user still needs to perform inconvenient operations that could advantageously be eliminated.

OBJECTS OF THE INVENTION

The main object of the invention is therefore to overcome the disadvantages of the prior art mentioned above, by providing an alarm clock having a case and in which the device for setting and cancelling the alarm signal is easy to operate, this device not being visible from the outside of the case and moreover capable of being made in a simple and economical manner.

BRIEF SUMMARY OF THE INVENTION

The instant invention accordingly provides an alarm clock having a case which houses a clock movement, said movement being connected to an alarm circuit comprising an alarm signal generator and means for setting and cancelling said alarm signal generator, said case being adapted to rest upon a rigid surface by foot means capable of movement between two positions and projecting from the base of the case, said foot means being furthermore connected to said means for setting and cancelling said circuit in such a way that, on the one hand, the latter are capable of being actuated when pressure is applied to the case, and that on the other hand, the case is adapted to move from a first position to a second position in response to said pressure.

In accordance with the invention, the foot means furthermore comprise means for returning the case of the alarm clock from its second position to its first position following application of said pressure on the latter, said foot means comprising auxiliary means permitting the alarm circuit to be set and cancelled by successive applications of pressure to the case, the foot means being connected to means for the display of the set and cancelled status of the alarm circuit of the alarm clock.

Thanks to these features, by simple successive applications of pressure to the case of the alarm clock, the alarm circuit of the latter may be successively set and cancelled without any particular manipulation of the alarm clock.

In a preferred embodiment of the invention, the means for returning the case of the alarm clock into its first position following application of pressure to the latter comprise an engagement mechanism of the "ball-point-pen" type which comprises a sleeve integral with the case, within which an upper stem and a lower stem slide, each of these stems being associated with a return spring, the two stems cooperating with one another by one of their extremities, termed first extremities, which comprise respectively a toothed crown wheel and a corresponding sliding pinion, the toothing of the wheel sliding in grooves provided in said sleeve and the toothing of the pinion sliding in the grooves or being stopped at one extremity of these latter depending on the angular position of the pinion.

Furthermore, the upper stem is connected by its second extremity to a contact strip forming part of a contact breaker for the alarm circuit and the lower stem is connected by its second extremity to a foot forming element belonging to the foot means of the alarm clock.

BRIEF DESCRIPTION OF THE INVENTION

The invention will be better understood from the teaching of the following description of an embodiment of an alarm clock equipped with a device of the invention, given as a non-limitative example in association with the attached drawings in which.

BRIEF DESCRIPTION OF THE INVENTION

Figure 1:
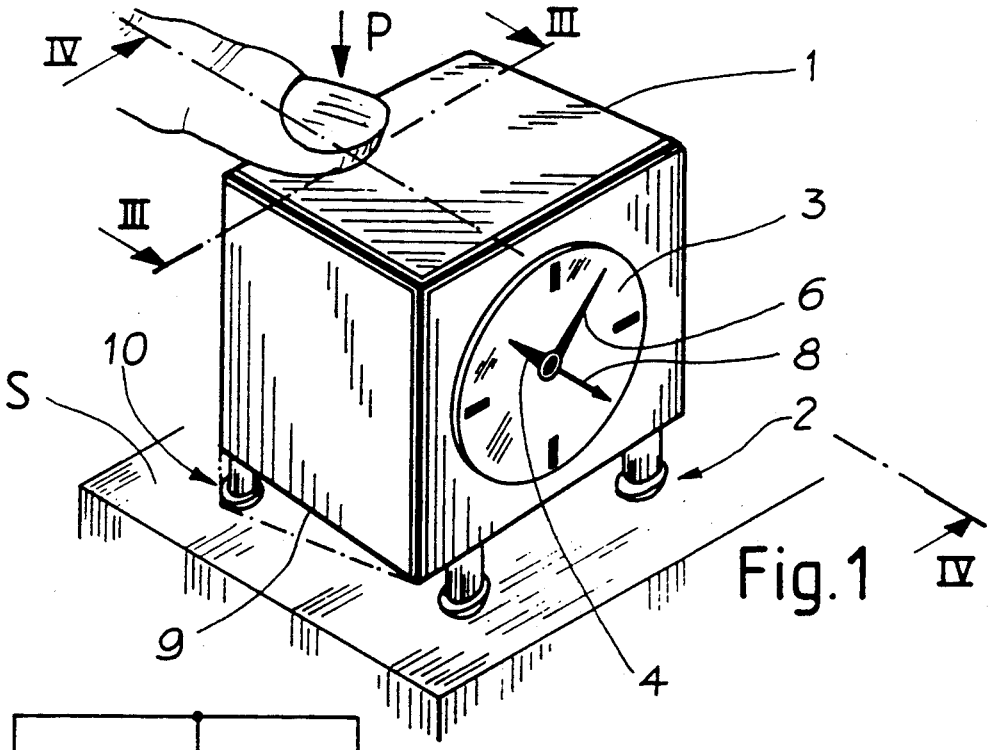
FIG. 1 is a perspective view of an alarm clock equipped with a setting and cancelling device for its alarm circuit of the invention.

With reference first of all to FIG. 1, there is shown an alarm clock of which the case 1 is of substantially parallelipipedic form. This case is adapted to rest upon a rigid surface S by foot means 2. This alarm clock comprises on a front face a dial 3 associated with an hour hand 4 and a minute hand 6. These latter are driven by a clock movement not shown in the drawing. The alarm clock furthermore comprises a hand 8 for indicating the time at which an alarm signal is to be triggered. This hand may of course be actuated manually from outside the case by means of a setting knob or by a similar device not shown.

The foot means 2 of this alarm clock comprise four feet projecting from the base 9 of the case, only three of which are visible in the drawing. The foot indicated by the reference numeral 10 forms, in conjunction with the case, the control element for the setting and cancelling means in accordance with the invention which will be described in greater detail in association with FIGS. 3 and 4.

Figure 2:
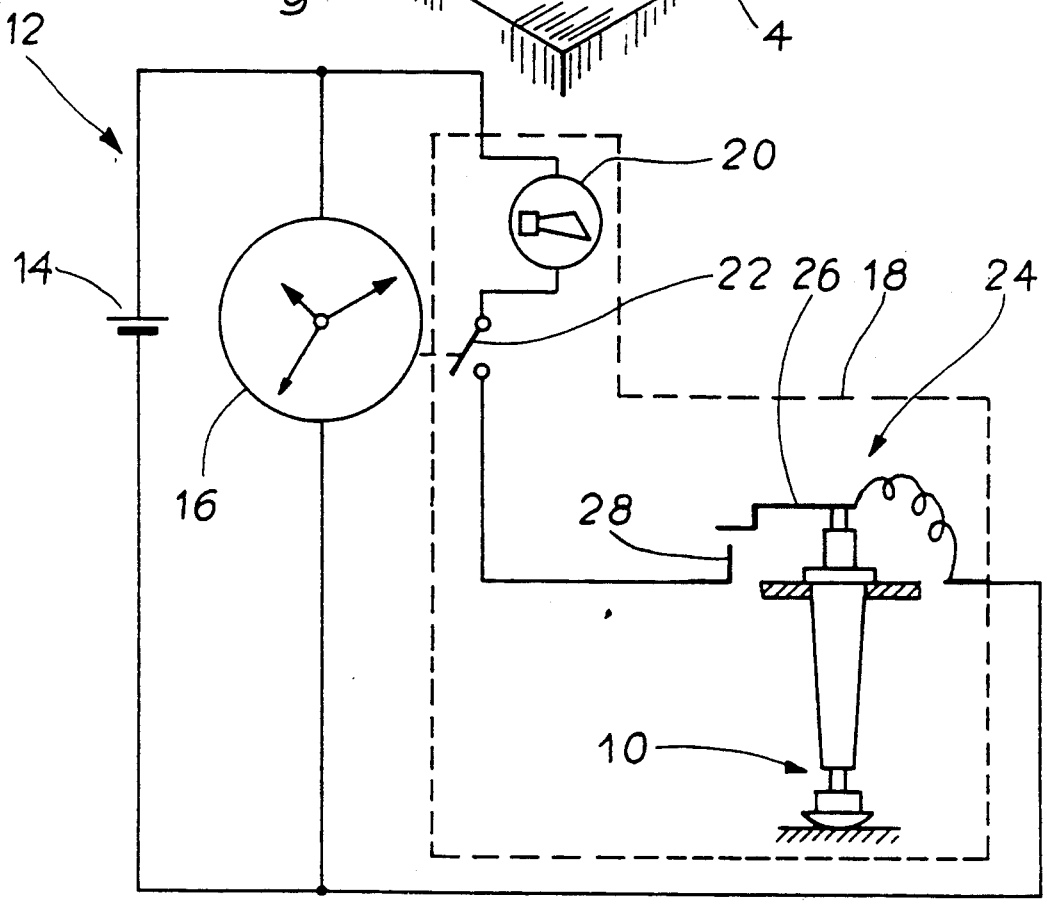
FIG. 2 is a simplified electrical circuit diagram representing the alarm circuit of this alarm clock connected to the device of the invention.

Referring now more particularly to FIG. 2, the circuit 12 of the alarm clock of the invention is shown. This circuit 12 comprises in conventional form a power source 14, for example a battery, connected in parallel to the input terminals of a clock movement 16 which is a quartz or similar electrical movement. This power source 14 is similarly connected to an alarm circuit 18 which comprises an alarm signal generator 20 connected in series to a contact breaker 22 operating in association with the hand 8 and at least the hour hand, together with means 24 for setting and cancelling the alarm circuit. These means 24 comprise a first moveable contact element 26 adapted to cooperate with a second fixed contact element 28 to form the contacts of a contact breaker. The contact element 26 has two stable positions and is directly connected to the control element 10 constituted by one of the feet of the alarm clock. It is to be noted that the status of the circuit 18 represented in the drawing corresponds to a status in which the alarm is cancelled, in other words in which the contact breaker constituted by the means 24 is open.

Referring now to FIGS. 3 to 6, the detail is shown of the construction of the setting and cancelling means 24, together with the way in which they are connected to the control element 10 and fitted within the case 1. As shown in particular in FIGS. 3 and 4, the first contact element 26 is formed by a contact strip, on the one hand fixed to the extremity of an actuating stem 30, and on the other hand connected to one of the terminals of the power source 14 by means of a flexible electric wire 32 suitably attached to this strip 26. The second contact element 28 is formed, in the example illustrated, by one extremity of a sleeve 29, within which the actuating stem 30 slides, this sleeve 29 being connected to the other terminal of the power source 14. It is self evident that in another embodiment, the second contact element 28 may be constituted by a strip integral with a wall of the case.

The actuating strip 30 forms part of an engagement mechanism of the well known "ballpoint-pen" type and which will not be described in detail here. This engagement mechanism 34 of substantially cylindrically form extends within the case 1 and is fitted in this latter on a collar 36 integral with one wall of the case. In the example described, the mechanism 34 is positively sleeved in an aperture provided in the base plate, but of course any other equivalent fitting means may be appropriate. This mechanism 34 comprises essentially the cylindrical conductive sleeve 29 in two parts 29*a*, 29*b* within which slide an upper stem 30 and a lower stem 40 (the upper stem 30 constituting the actuating stem quoted above).

Each of these two stems 30, 40 is connected to a return spring 42, 44 respectively and cooperate with one another by a first extremity by means of a sliding pinion 46 having asymmetrical crown toothing and by a wheel 48 having asymmetrical crown toothing. Furthermore, the two stems are respectively connected by their second extremity to the contact strip 26 and to a foot 50 extending in sliding manner through the wall 52 of the base of the case.

In this regard it is to be noted that the upper stem 30 is non-conductive or is insulated in relation to the sleeve 29 within which it slides, failing which the contact breaker constituted by the means 24 would be inoperative.

Figure 3:
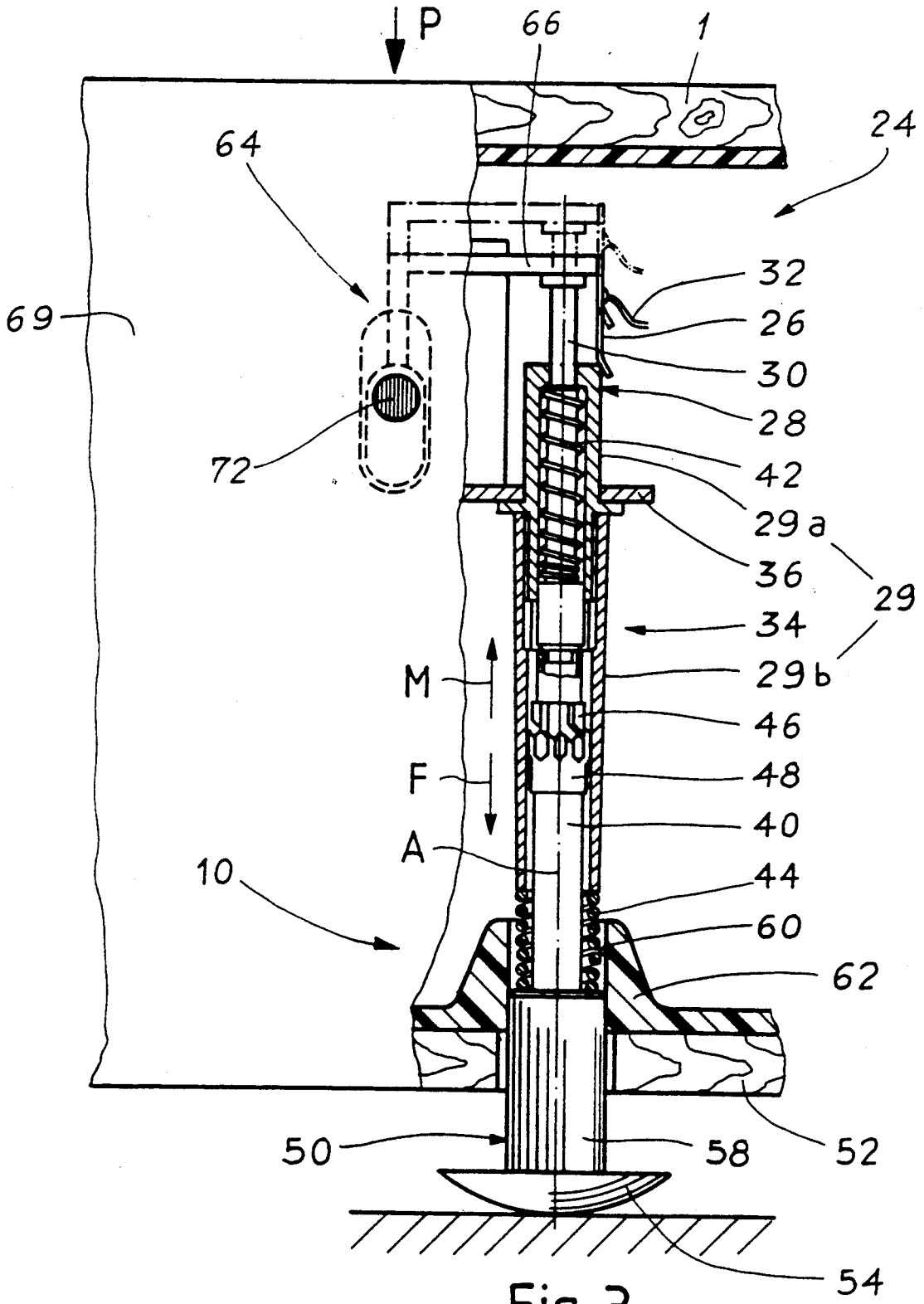
FIGS. 3 and 4 are partial cross-sections along the lines III—III and IV—IV respectively of FIG. 1, illustrating the setting and cancelling device of the invention.
Figure 5:
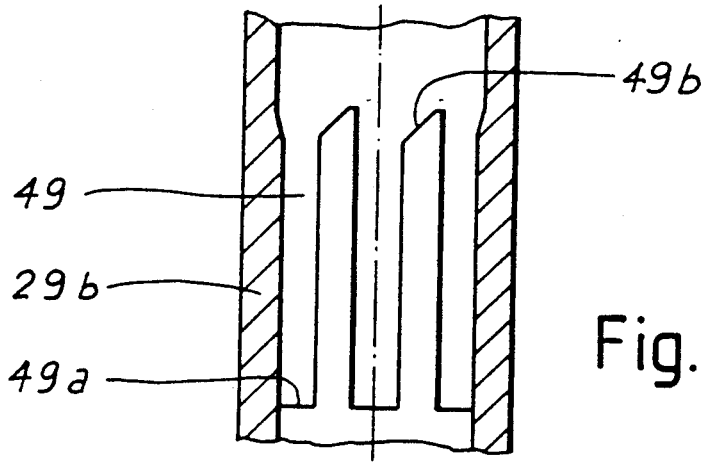
FIGS. 5 and 6 are partial enlarged views of the engagement mechanism associated with the setting and cancelling means of the alarm signal of the invention.
Figure 6:
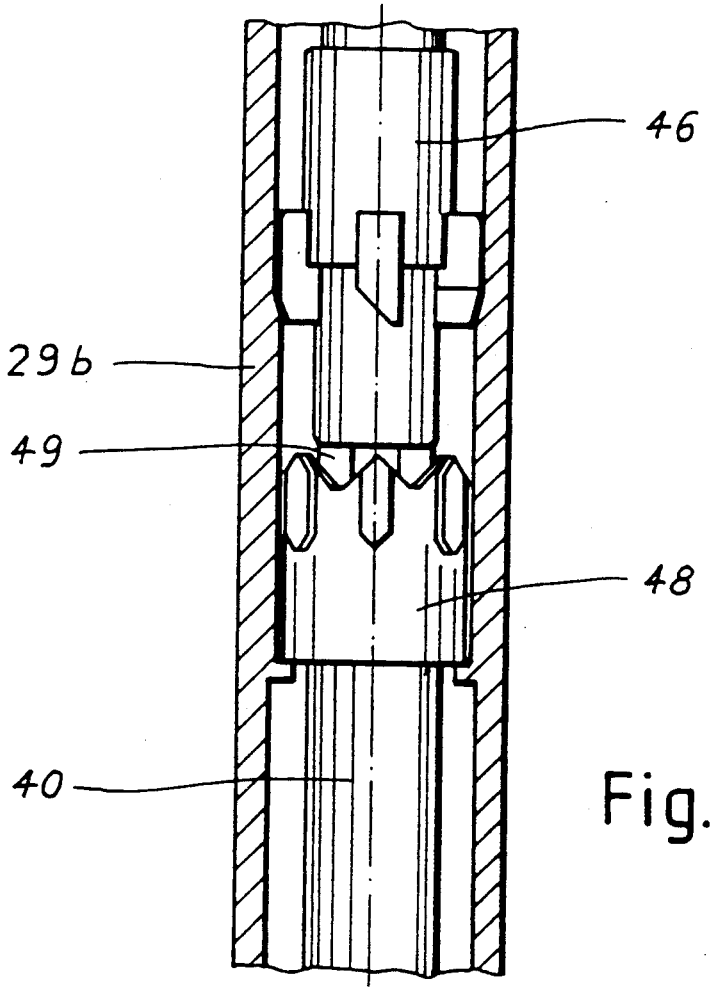

Referring more particularly to FIGS. 5 and 6, it will be noted that the pinion 46 and the wheel 48 slide by means of their toothing in guide grooves 49 provided inside and on one part of the sleeve element 29*b*. More specifically, these grooves comprise at a first extremity stop surfaces 49*a* and at an opposing extremity ratchet planes 49*b* (FIG. 5). The sides of the pinion teeth 46 are therefore able, as a function of their angular position about the axis A of the mechanism given by the wheel 48 during the actuation of the mechanism 34 by pressure on the case, either to press against the ratchet planes 49*b*, as shown in FIG. 6, or to slide in the grooves 49 and rest against the toothing of the wheel 48 as shown in FIG. 3. In contrast, when the stem 40 is retracted by the spring 44 in the direction of the arrow F, the wheel 48 integral with the stem 40 comes into contact by means of its side 48*a* with the stop surfaces 49*a* in such a way that the foot 50 projects from the base of the case at a substantially constant distance, regardless of the position of the pinion 46.

Referring once again to FIGS. 3 and 4, it will be noted that the foot 50 comprises a first part 54 being in the shape of a portion of a sphere adapted to rest on a rigid surface S and a second part 58 having the configuration of a cylinder in which the second extremity of the lower stem 40 is fixed, for example by screwing in. This cylindrical part 58 passes through the bottom 52 and slides within a guide cylinder 60 provided in a boss 62 fixed to the inner face of the wall 52. In the example illustrated, the case is made of wood and the boss is attached. Of course in a variant in which the case is made of plastics material, the boss may easily be a material part of the wall. The use of such a mechanism advantageously permits the contact strip 26 to be allocated two stable positions by successive simple applications of pressure to the case. More precisely, the strip 26 forming the contact breaker can be moved between a neutral position in which the alarm circuit is open (represented by broken lines in the drawing) and an operational position in which said circuit is closed (represented by solid lines in the drawing).

Figure 4:
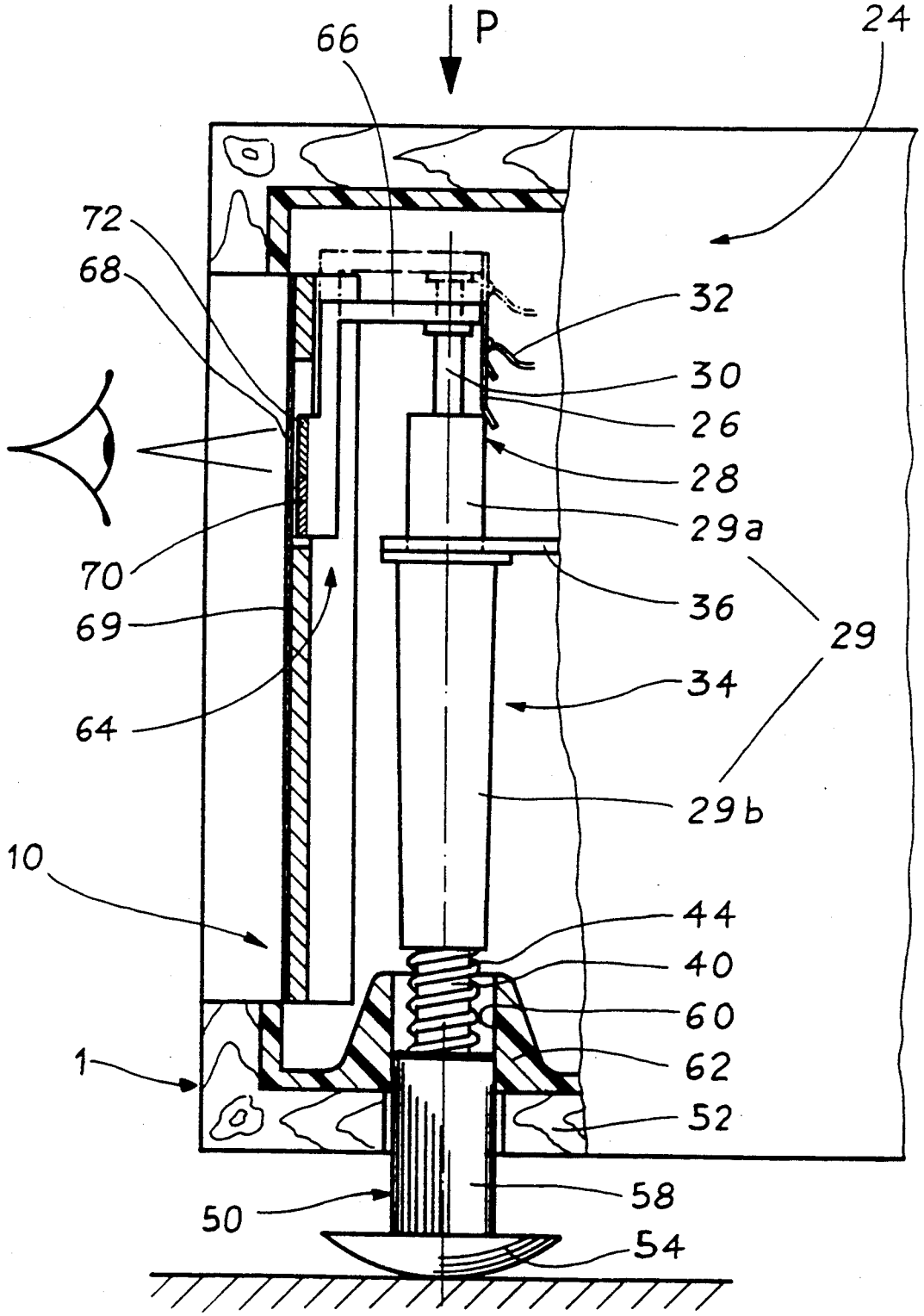

It will also be seen from FIGS. 3 and 4 that the alarm clock comprises display means 64 permitting indication of the set or cancelled status of the alarm circuit of the alarm clock. These display means 64 are connected to the second extremity of the upper stem 30 through the intermediary of a connecting element 66. These means are formed by an indicator 64 which shifts in relation to an aperture 68 provided in a side wall 69 of the case of the alarm clock and which is visible through this aperture 68. This indicator 64 comprises two zones 70, 72 having distinctive appearances, each of them being representative of the open or shut status of the contact breaker formed by the contact strips 26 and 28. Therefore it is possible by a glance at the case to perceive easily the set or cancelled status of the alarm clock.

So that the set or cancelled status may be equally visible in an unlit room, provision may be made of course in an embodiment for the two zones 70, 72 of the indicator to be painted using a paint containing luminescent substances.

The setting and cancelling device of the alarm signal of the invention operates in the follow manner:

In a first position corresponding to its operational position, the contact strip 26 is in contact with the part 29*a* of the conductive sleeve 29 and the alarm circuit 18 is in a state of readiness. Thus when the time by the clock corresponds to the desired time for the alarm (indicated by the hand 8) the contact 22 closes and triggers the alarm signal produced by the generator 20. At this moment, to switch off this alarm signal, it suffices to apply pressure P to the case. The cylindrical part 58 of the foot then passes into the case, compresses the spring 44, and actuates the engagement mechanism 34 in the following manner.

The wheel 48 integral with the stem 40 slides in the grooves 49 and pushes the pinion 46 in the direction of the arrow M by imparting thereto, as soon as the pinion emerges from the grooves, a rotation by a fraction of a revolution about the axis A in such a way that, when the pressure exerted on the case has stopped, the pinion rests by means of its teeth on the ratchet planes 49. The stem 30 is then in a second stable position corresponding to its rest position (shown as a broken dotted line in the FIGURE) and in which the contact breaker composed of the contact element 26 and the sleeve part 29*b* is open. The alarm generating signal is then no longer supplied and the alarm stops.

At the same time, when pressure ceases to be exerted, the stem 40, and consequently the foot 50, has been brought back to its initial position relative to the case by the spring 44.

If pressure is again applied to the case, the foot presses into the case, compresses the spring 44 and reactuates the engagement mechanism 34. The wheel 48, as already mentioned above, then actuates the pinion 46 which is once again caused to rotate by a fraction of a revolution in such a way that its teeth no longer rest on the engagement planes and that these latter can slide in the grooves 49 to rest, as soon as pressure stops, against the toothing of the wheel 48 as shown by a heavy line in FIG. 3.

The actuating element 30 is returned to its first position, thus placing the contact strip 26 in its operational position, so that the alarm circuit is again set in a state of readiness, and is ready to ring as soon as the hour hand corresponds to the time indicated by the alarm hand 8.

Thus, as a result of this engagement mechanism 34, successive applications of pressure to the case permit the successive setting and cancellation of the alarm circuit of the alarm clock, all these operations being capable of being continuously verified by the position of the indicator 64 visible through the aperture 68.

It is also to be noted that the alarm clock in all the positions (set, cancelled) maintains a constant level in relation to the ground.

I claim:

1. An alarm clock comprising a case in which is housed a clock movement, this movement being associated with an alarm circuit comprising an alarm signal generator and means for setting and cancelling said alarm signal generator, said case being adapted to rest on a rigid surface by foot means capable of movement between two positions and projecting from the base of the case, said foot means being furthermore connected to said means for setting and cancelling in such a way that, on the one hand, the latter are capable of being actuated by pressure applied to the top of the case and that, on the other hand, the case is capable of being shifted from a first position to a second position in response to said pressure, wherein the foot means furthermore comprise means for returning the case of the alarm clock from its second position to its first position following application of said pressure, said foot means comprising auxiliary means permitting the alarm circuit to be set and cancelled by successive applications of pressure to the case, whilst the foot means are connected to means for display of the set and cancelled status of the alarm circuit of the alarm clock.

2. An alarm clock as claimed in claim 1, wherein the means for returning the case of the alarm clock from its second position to its first position comprises an engagement mechanism of the "ballpoint-pen" type which comprises a sleeve integral with the case in which slide an upper stem and a lower stem, each of these stems being associated with a return spring, the two stems cooperating with each other by means of one of their extremities referred to as first extremities, these first extremities having respectively a toothed crown wheel and a corresponding sliding pinion, the toothing of the wheel sliding in grooves provided in said sleeve and the toothing of the pinion sliding in grooves or being stopped at one extremity of these latter according to the angular position of the pinion.

3. An alarm clock as claimed in claim 2, wherein said upper stem is connected by its second extremity to a contact strip forming part of a contact breaker for the alarm circuit and in which said lower stem is connected by its second extremity to a foot forming element of the foot means.

4. An alarm clock as claimed in claim 3, wherein the foot forming element is formed of at least two parts, a first part being adapted to rest on said rigid surface, and a second part extending in sliding fashion into a guide piece provided in the case.

5. An alarm clock as claimed in claim 3, wherein the second part of the foot forming element is cylindrical and slides within a guide cylinder provided in a boss fitted in the base of the case.

6. An alarm clock as claimed in claim 3, wherein the second extremity of said upper stem is also connected to the means for display of the set or cancelled status of the alarm circuit of the alarm clock.

7. An alarm clock as claimed in claim 6, wherein said display means comprise an indicator which moves in relation to an aperture provided in one of the walls of the case.

8. An alarm clock as claimed in claim 7, wherein said indicator comprises on its surface, which is visible through said aperture, two zones each being of distinctive appearance representative of the set and cancelled status of the alarm circuit.

* * * * *